United States Patent [19]

Nelson

[11] Patent Number: 4,471,933

[45] Date of Patent: Sep. 18, 1984

[54] MUSIC STAND

[76] Inventor: Donald R. Nelson, 20 Vista Dr., Shrewsbury, Mass. 01545

[21] Appl. No.: 294,883

[22] Filed: Aug. 21, 1981

[51] Int. Cl.[3] ..... A47B 97/04

[52] U.S. Cl. ..... 248/461

[58] Field of Search ..... 248/165, 250, 454, 455, 248/460, 461

[56] References Cited

U.S. PATENT DOCUMENTS

| | | | |
|---|---|---|---|
| 97,360 | 11/1869 | Conley | 248/454 |
| 1,069,617 | 8/1913 | Ilvonen | 248/461 |
| 1,103,286 | 7/1914 | Hallett | 248/165 |
| 1,330,388 | 2/1920 | O'Donnell | 248/461 |
| 1,391,491 | 9/1921 | O'Donnell | 248/461 |
| 1,951,960 | 3/1934 | Anduaga | 248/455 |
| 2,156,489 | 5/1939 | Bonetti | 248/461 |
| 2,549,306 | 4/1951 | Greene | 40/102 |
| 3,378,322 | 4/1968 | Johnson | 312/231 |

*Primary Examiner*—William H. Schultz

*Attorney, Agent, or Firm*—Blodgett & Blodgett

[57] ABSTRACT

Music stand which is convertible to a carrying case, including a base, a supporting post removably attachable to the base, a music tray removably attachable to the supporting post and adapted to overlie the base upon removal of the supporting post to form a completely enclosed carrying case, and means for fastening the music tray to the base so that the carrying case can be transported as a unitary structure.

8 Claims, 5 Drawing Figures

MUSIC STAND

BACKGROUND OF THE INVENTION

This invention relates generally to a music stand and, specifically, to a music stand that converts into a compact carrying case.

Musicians are generally required to perform in many different types of facilities and under a variety of circumstances. In a majority of cases, the facility in which the musician must perform lacks the necessary equipment for musical performances. As a result, musicians must be prepared to carry all of the required equipment for each performance. This includes sound amplifications systems and music stands in addition to sheet music and instruments.

The amount of equipment that is normally required for a performance has increased substantially in recent years, because of the electronic sophistication that audiences have become accustomed to expect. This means that at the minimum a large station wagon must be used to transport the equipment. In most cases a van or small truck is needed, depending on the size of the van and the size of the amplification equipment. A great deal of time has to be spent loading and unloading the equipment. Several trips have to be made between the van or transporting vehicle and the stage for setting up and taking down for each performance.

Most of the equipment is carried in music cases; including instruments, sheet music, and other small items which will fit into the case. The music stands must be carried separately. These and other difficulties experienced with the prior art devices have been obviated by the present invention.

It is, therefore, an outstanding object of the invention to provide a music stand which can be disassembled into a compact package which can be easily carried.

Another object of this invention is the provision of a music stand which can be disassembled and formed into a carrying case which can also be used to carry other equipment, such as sheets of music, instruments, etc.

A further object of the present invention is the provision of a music stand which can be disassembled and formed into a carrying case and which is also adjustable in height.

It is another object of the instant invention to provide a music stand which can be disassembled and formed into a carrying case, so that one part of the carrying case functions as a base of the music stand in which sheet music and other ancillary equipment can be stored during a performance and another part of the carrying case forms a music tray.

A still further object of the invention is the provision of a music stand which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a music stand which is convertible into a carrying case for sheet music, musical instruments and the like. The music stand has a base portion and a music tray portion which, together, combine to form a completely enclosed carrying case. The music tray is attached to the base by fastening means, so that the case can be transported as a unitary structure. A supporting post is used to connect the base to the tray when the parts are used as a music stand.

More specifically, the fastening means consists of cooperating latch elements permanently attached to the base and tray portions and one of the side walls of the base is provided with a slot for receiving one of the side walls of the tray when the tray is inverted. The opposite side walls of the base and tray overlap and contain the fastening means.

BRIEF DESCRIPTION OF THE DRAWINGS

The character of the invention, however, may be best understood by reference to one of its structural forms, as illustrated by the accompanying drawings, in which.

BRIEF DESCRIPTION OF THE PREFERRED EMBODIMENT

Figure 1:
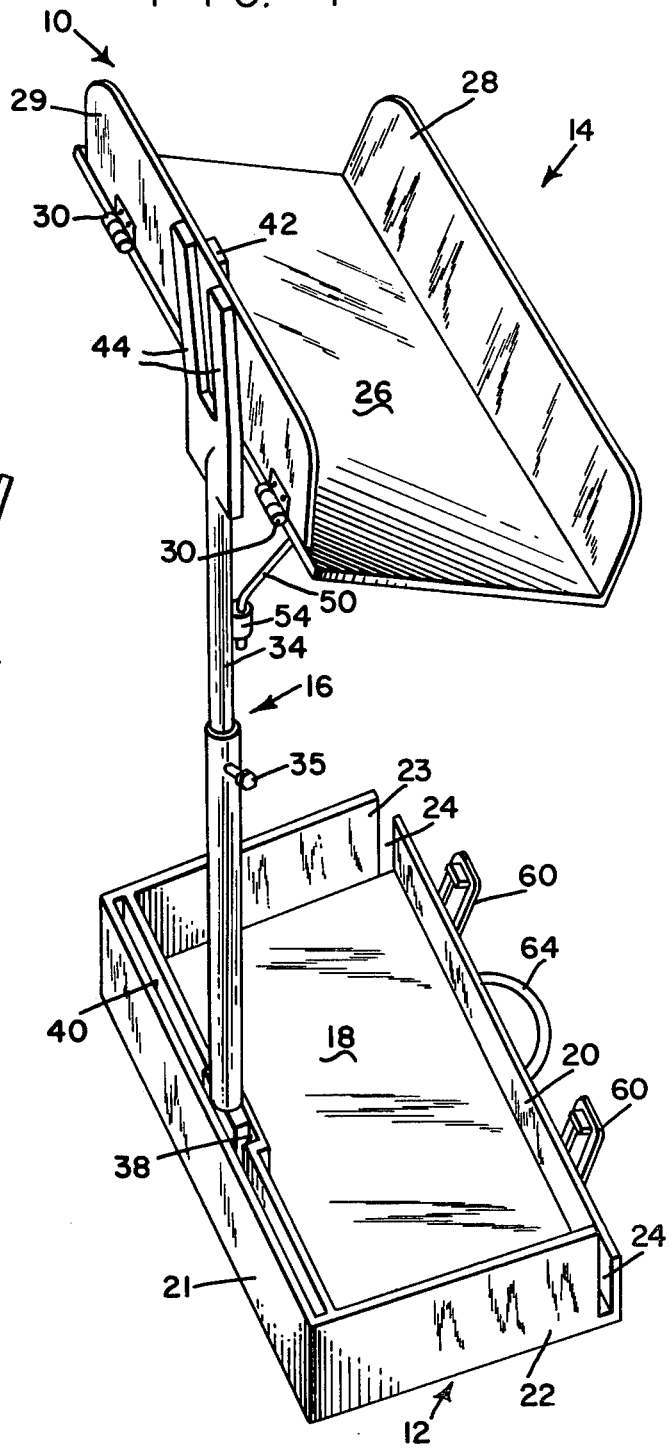
FIG. 1 is a perspective view of the music stand in the assembled state in which it functions as a music stand.
Figure 2:
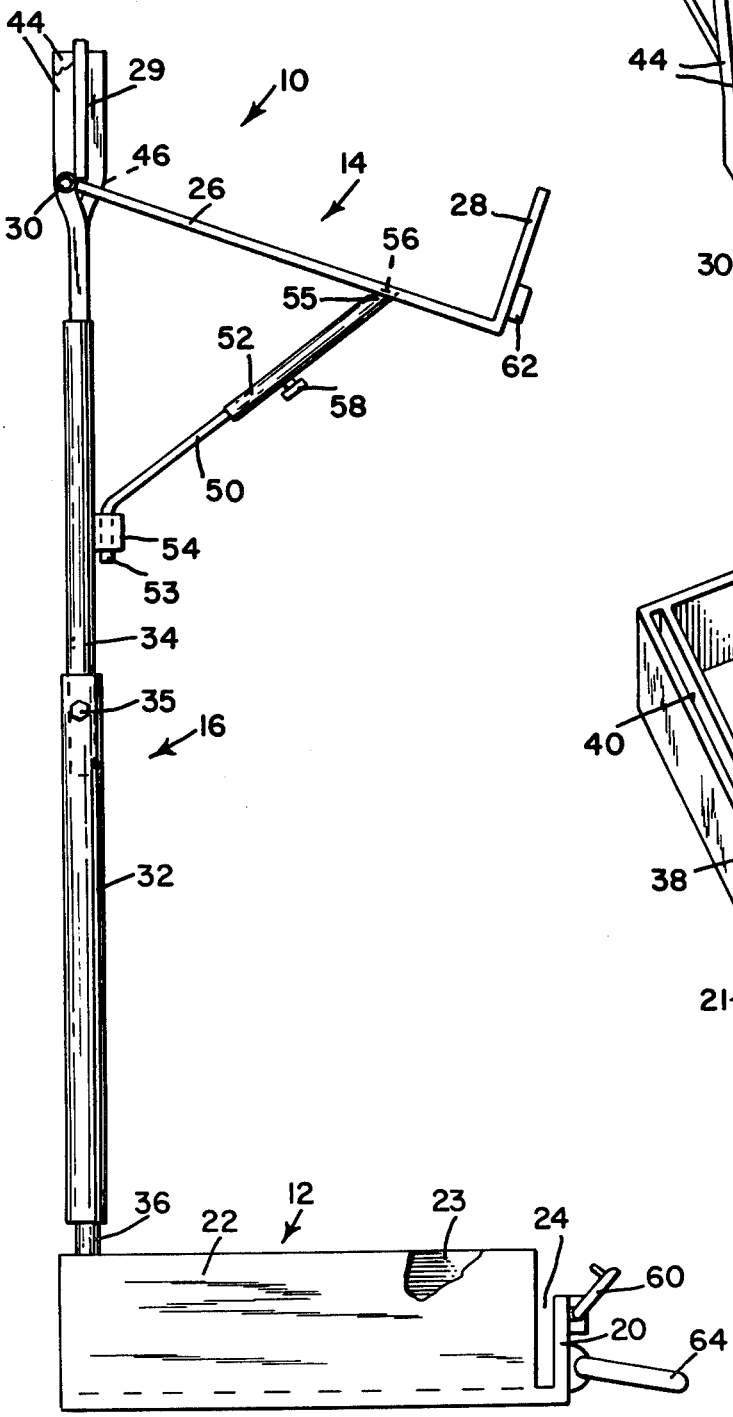
FIG. 2 is a side elevational view of the music stand.

Referring first to FIGS. 1 and 2, which best show the general features of the invention, the music stand, indicated generally by the reference numeral 10, is shown in the assembled condition in which it functions as a music stand. The music stand 10 consists of a base generally indicated by the reference numeral 12, a trIay generally indicated by the reference numeral 14, and a supporting post generally indicated by the reference numeral 16, which post connects and supports the tray 14 to the base 12.

The base 12 has a flat planar bottom wall 18 and a plurality of side walls which form an open top. The side walls comprise a front wall 20, a back wall 21 and end walls 22 and 23. The end walls 22 and 23 are integrally connected with the back wall 21 and are spaced from the front wall 20 as indicated by the reference numeral 24. As shown in FIGS. 1 and 2, the front wall 20 does not extend as high as the back wall 21 or the end walls 22 and 23. The back wall 21 is provided with a vertical slot extending along its entire length from one end wall 22 to the other end wall 23. The slot 40 has an enlarged central portion 38 for a purpose to be described.

The tray 14 has a flat planar bottom wall 26 and a pair of side walls 28 and 29. The side wall 28 is integral with the bottom wall 26 and constitutes the front wall of the tray. The side wall 29 is hingedly connected to the bottom wall 26 as indicated by reference numerals 30 and constitutes the back wall of the tray.

The supporting post 16 comprises a tubular bottom portion 32 and a top portion 34 slidably mounted in the bottom portion 32 in telescoping fashion and held in a fixed vertical position by means of a set screw 35. The lower end bottom portion 32 has a flat portion 36 which fits into the enlarged portion 38 of the slot 40 for maintaining the supporting post in a fixed vertical position. The upper end of the top portion 34 has an inner prong 42 and a pair of outer prongs 44 spaced from each other and offset from the inner prong 42. When the tray 10 is in the assembled condition, as shown in FIGS. 1 and 2, the inner prong 42 extends through a notch 46 in the bottom wall 26 and the outer prongs 44 extend along the outer surface of the back wall 29 for supporting the tray 14. The notch 46 is shown more clearly in FIGS. 3–5.

The tray 14 is maintained in the desired angular position with respect to the supporting post 16 by means of a brace generally indicated by the reference numeral 48 and comprising a lower portion 50 and an upper tubular portion 52. One end of the lower portion 50 is slidably mounted in the upper portion 52 in telescoping fashion. The opposite end of the lower portion 50 has an offset portion 53 which is hooked into an apertured bracket 54 extending from the top portion 34. The opposite end of the top portion 52 has a tapered portion 55 which fits into a notch 56 in the bottom surface of the bottom wall 26. By sliding the lower portion 50 within the upper portion 52, the angular position of the tray 14 can be adjusted to a desired angular position. This angular position can be maintained by means of a set screw 58 which locks the upper and lower portion 52 and 50, respectively, against relative longitudinal motion.

Figure 4:
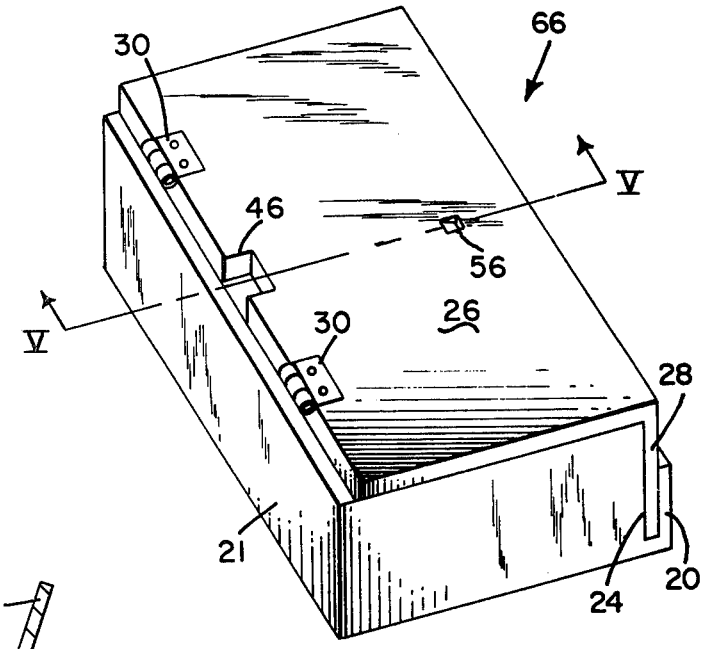
FIG. 4 is a perspective view of the disassembled music stand when converted into a carrying case.
Figure 5:
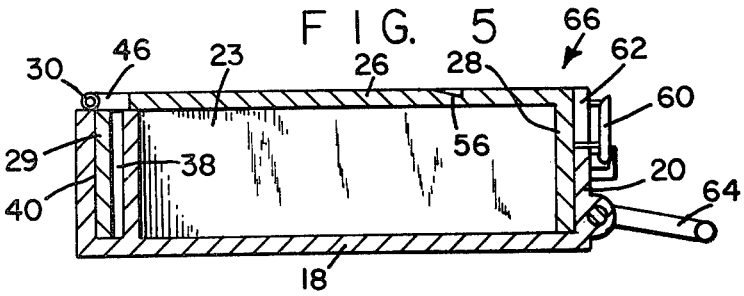
FIG. 5 is a vertical sectional view of the carrying case taken on the line V—V of FIG. 4.

Front wall 20 of the base is provided with a pair of latch elements 60 which are lockingly engageable with a pair of latch elements 62 on the outside of the front wall 28 when the music tray 10 is converted into a carrying case. The carrying case is generally indicated by the reference numeral 66, as shown in FIGS. 4 and 5.

Figure 3:
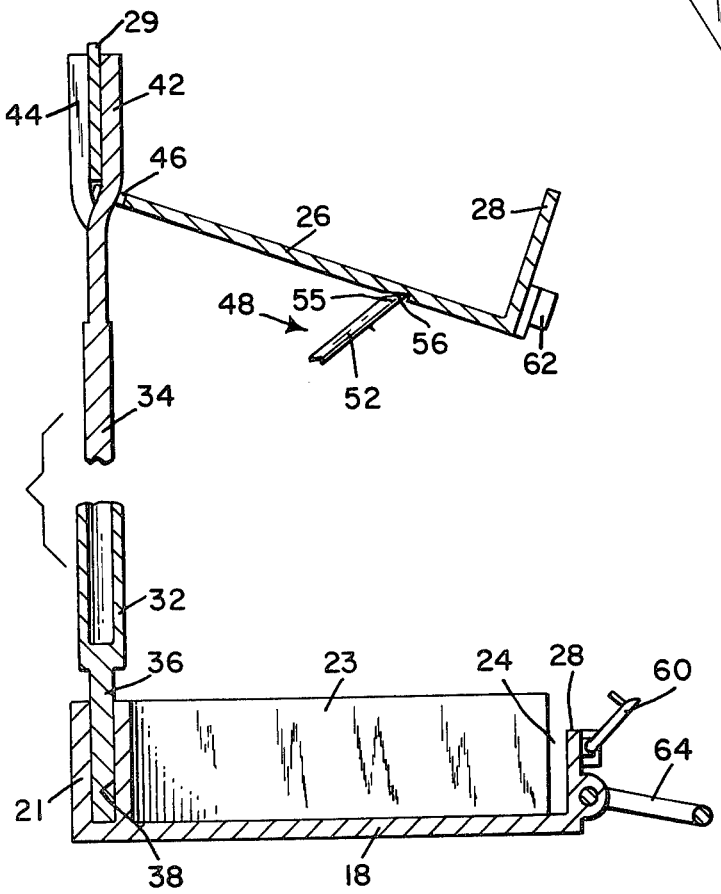
FIG. 3 is a vertical cross-sectional view of the music stand with portions broken away.

In view of the above description, the manner in which the music tray 10 shown in FIGS. 1–3 is disassembled and converted into the carrying case 66, shown in FIGS. 4 and 5 will now be described.

The music tray 10 is disassembled by first removing the brace 48. This is accomplished by slipping the tapered end 55 out of the notch 56 and then lifting the end 53 out of the supporting bracket 54. The set screw 58 is loosened and the lower portion 50 is collapsed within the upper portion 52 and the brace 48 is placed in the base 18. The tray 14 is then lifted free of the prongs 42 and 44 and temporarily placed on the floor. Set screw 35 is then loosened and the top portion 34 is removed from the bottom portion 32 of the supporting post 16. The bottom portion 32 is then lifted out of the enlarged portion 38 of the slot 40 and the lower portion 32 and the upper portion 34 are both placed in the base 12.

The last step involves the placing of the tray over the base in its inverted position. However, before this is done the base 12 is filled with one or more musical instruments, sheet music or other small musical accessory items. Finally, the tray 14 is applied to the base 12 by inserting the back wall 29 into the slot 40 and then swinging the bottom wall 26 of the tray so that the front wall 28 slides behind the front wall 20 of the base and occupies the space 24. The walls 20 and 28 overlap as shown in FIGS. 4 and 5. Latch elements 60 are then swung into engagement with latch elements 62 to lock the tray 14 firmly on the base 12 and to allow the carrying case 66, with its contents, to be carried by the handle 64.

The music stand 10 is re-assembled by reversing the above steps.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Music stand which is convertible into a carrying case for sheet music, musical instruments, and the like, said music stand comprising:

(a) a base having a rectangular planar bottom wall, a vertical front wall, and a vertical back wall, said front and back walls being fixed at respective opposite edges of said bottom wall, (b) a supporting post removably attachable to the base, (c) a music tray removably attachable to the supporting post, said tray having a rectangular planar bottom wall, a vertical front wall and a vertical back wall, said front wall being fixed to one edge of the bottom wall of the tray and said back wall being hingedly connected to an opposite edge of the bottom wall of said tray, said tray being adapted to overlie the base upon removal of the supporting post to form a completely enclosed carrying case, said case having a pair of opposite side walls fixed to one of said bottom walls, (d) mounting means for mounting the back wall of the tray to the back wall of the base, and (e) means for latching the front wall of the tray to the front wall of the base so that the carrying case can be transported as a unitary structure.

2. Music stand as recited in claim 1, wherein the front wall of the tray is adapted to overlap the front wall of the base when the tray and base are assembled and the latching means comprise latching elements located on each of said front walls.

3. Music stand as recited in claim 1, wherein said mounting means is a vertical slot in the back wall of the base for receiving the back wall of the tray.

4. Music stand as recited in claim 1, wherein said music stand comprises a disconnectable supporting brace extending from the tray to the supporting post.

5. Music stand as recited in claim 1, wherein the supporting post comprises:

(a) a bottom portion attachable to the base, (b) a top portion attachable to the tray and telescopingly mounted on the bottom portion, and (c) locking means for locking the top portion relative to the bottom portion.

6. Music stand as recited in claim 1, wherein one of said vertical walls has a carrying handle.

7. Music stand which is convertible into a carrying case for sheet music, musical instruments, and the like, said music stand comprising:

(a) a base having a flat planar bottom wall and a plurality of side walls, one of said side walls being provided with a slot which includes an enlarged portion, (b) a supporting post removably insertable in said enlarged portion for attachment to the base, (c) a music tray removably attachable to the supporting post, said tray having a flat planar bottom wall and a plurality of side walls, one of the side walls of the tray being insertable in said slot, said tray being adapted to overlie the base upon removal of the supporting post to form a completely enclosed carrying case, and (d) means for fastening the music tray to the base so that the carrying case can be transported as a unitary structure.

8. Music stand which is convertible into a carrying case for sheet music, musical instruments, and the like, said music stand comprising:

(a) a base having a flat planar bottom wall and a plurality of side walls, one of said side walls being provided with a slot, (b) a supporting post removably attachable to the base, the top of said supporting post being provided with a plurality of upwardly extending prongs which are offset from each other.

(c) a music tray removably attachable to the supporting post, said tray having a flat planar bottom wall and a plurality of side walls, one of the side walls of the tray being insertable in said slot, said tray being adapted to overlie the base upon removal of the supporting post to form a completely enclosed carrying case, the bottom wall of the tray being provided with a notch where the bottom walls join one of the side walls of the tray so that at least one of said prongs extends through said notch end along the inside of said one wall and at least one of the remaining prongs extends along the outside of said one side wall, and (d) means for fastening the music tray to the base so that the carrying case can be transported as a unitary structure.

* * * * *